United States Patent [19]

Dunagan

[11] Patent Number: 5,005,594

[45] Date of Patent: Apr. 9, 1991

[54] WIG ANCHOR

[76] Inventor: Geneva R. Dunagan, 804 Edwards Blvd., Big Spring, Tex. 79720

[21] Appl. No.: 393,830

[22] Filed: Sep. 26, 1989

Related U.S. Application Data

[63] Continuation of Ser. No. 108,697, Oct. 16, 1987, abandoned.

[51] Int. Cl.[5] ..... A41G 5/00

[52] U.S. Cl. ..... 132/53; 132/54

[58] Field of Search ..... 132/53, 54, 56

[56] References Cited

U.S. PATENT DOCUMENTS

| | | | |
|---|---|---|---|
| 3,458,943 | 8/1969 | Trowbridge | 132/53 |
| 3,485,249 | 12/1969 | Mast | 132/53 |
| 3,665,940 | 5/1972 | Schordalides et al. | 132/53 |
| 3,980,092 | 9/1976 | Garufi | 132/53 |
| 4,150,678 | 4/1979 | Photopulos | 132/53 |

*Primary Examiner*—Gene Mancene
*Assistant Examiner*—Adriene B. Lepiane
*Attorney, Agent, or Firm*—William W. Haefliger

[57] ABSTRACT

An article for positioning and maintaining a wig on the head of a wearer having little or no natural hair, which comprises an envelope adapted to be disposed between the wig and the head of the wearer, the envelope having a first side adapted to substantially conform to the underside of the wig and a second side adapted to substantially conform to the head of the wearer, filler material for use within the envelope, and a fastener for attaching the envelope to the underside of the wig.

7 Claims, 2 Drawing Sheets

WIG ANCHOR

FIELD OF THE INVENTION

This application is a continuation of application Ser. No. 108,697, filed Oct. 16, 1987, now abandoned (Sept. 29, 1989).

This invention relates to wigs, and more particularly, to a wig anchor for use in positioning and maintaining a wig on the head of a user having little or no hair. Another aspect of the invention relates to a kit comprising a wig anchor and means for attaching the wig anchor to a wig support frame.

BACKGROUND

Conventional wigs are constructed by attaching strands of natural or synthetic hair to an underlying wig support frame which typically comprises loosely woven netting adapted to be stretched over the head of the wig user. Elastic material disposed around the periphery of the wig support frame then contracts around the head at or about the natural hair line. The wig user thereby achieves an outward appearance that more or less approximates a natural look, depending on the quality and styling of the wig.

Because most wig users wear wigs over their natural hair, manufacturers of conventional wigs have designed and fabricated a hair pocket into the crown of each wig support frame. This hair pocket is generally a hemispherically shaped recess or outward bulge in the wig support frame that provides a void into which the wig wearer can stuff his or her natural hair when putting on the wig. When the wig wearer's own hair is pulled up and stuffed into the hair pocket, the outward bulge in the wig support frame is largely concealed by the strands of wig hair covering the crown of the head, thereby promoting a more natural appearance. The gathering and placement of natural hair into the hair pocket of the wig also assists in maintaining the wig in the desired position on the head of the wearer during use.

Significant problems have been encountered, however, when persons having little or no natural hair attempt to wear conventional wigs. The absence of a well defined hairline and the absence of hair which can be gathered and placed into the hair pocket of the wig frame leave no means of maintaining the wig in the desired position on the head of the wearer during use. Furthermore, there is no natural hair to which the wig hair or wig support frame can be pinned to anchor the wig on the head of the wearer. Without satisfactory means for anchoring the wig on the head of the wearer, the wig frequently shifts out of position during use, causing an unnatural outward appearance and embarrassment to the user.

Some have attempted to overcome the above-mentioned problems encountered by users with little or no hair through the use of adhesives which releasably adhere the wig support frame directly to the scalp of the wearer. Others have attempted to anchor conventional wigs by first placing a scarf, stocking or skull cap over the head which will assist in keeping the wig from sliding or shifting on the scalp of the wearer. However, both of these means have proved to be unsatisfactory methods for positioning and maintaining a wig on the head of a user having little or no hair, and particularly so where the absence of natural hair is the result of chemotherapy treatments prescribed for patients diagnosed as having cancer.

When individuals undergo chemotherapy treatments which result in the loss of natural hair, the scalp tissue typically becomes very sensitive to pressure and irritation. For such patients there has heretofore been no way to wear a conventional wig without experiencing either significant discomfort or embarrassment. Because of the lack of a satisfactory device or apparatus for anchoring a conventional wig to the scalp, such patients have been forced to turn to less desirable alternatives such as hats, turbans or scarves for covering their heads. The use of such alternatives can cause the scalp of the wearer to become hot, sweaty and/or itchy.

SUMMARY OF THE INVENTION

According to the present invention, an article is provided that will enable persons having little or no natural hair to wear conventional wigs. According to one preferred embodiment of the invention, a wig anchor is provided that is adapted to releasably engage the hair pocket of a conventional wig, and to situate the wig on the scalp of the wearer so as to reduce slippage of the wig and resultant embarrassment.

According to another embodiment of the invention, a wig anchor is provided that is adapted to help situate a wig on the head of an individual having little or no natural hair, and to cushion the scalp under the weight of the wig.

According to another embodiment of the invention, a wig anchor is provided that is adapted to be disposed within and releasably adhere to the hair pocket of a conventional wig so as to assist in positioning and maintaining the wig in a desired position on the scalp and to cushion the scalp of the wearer.

According to another embodiment of the invention, a wig anchor is provided that can be easily moved from one wig to another, and that can be adjusted to accommodate different head sizes and/or wigs having hair pockets of differing depths.

According to another embodiment of the invention, a kit is provided that comprises the wig anchor of the invention in combination with means for releasably attaching the wig anchor to a wig.

According to another embodiment of the invention, a kit is provided that comprises the wig anchor of the invention in combination with filler material that is useful for increasing the thickness of the wig anchor.

BRIEF DESCRIPTION OF THE DRAWINGS

The present invention is further described and understood with reference to the following drawings, in which like numerals are used for like parts in each of the figures.

DESCRIPTION OF THE PREFERRED EMBODIMENTS

Figure 1:
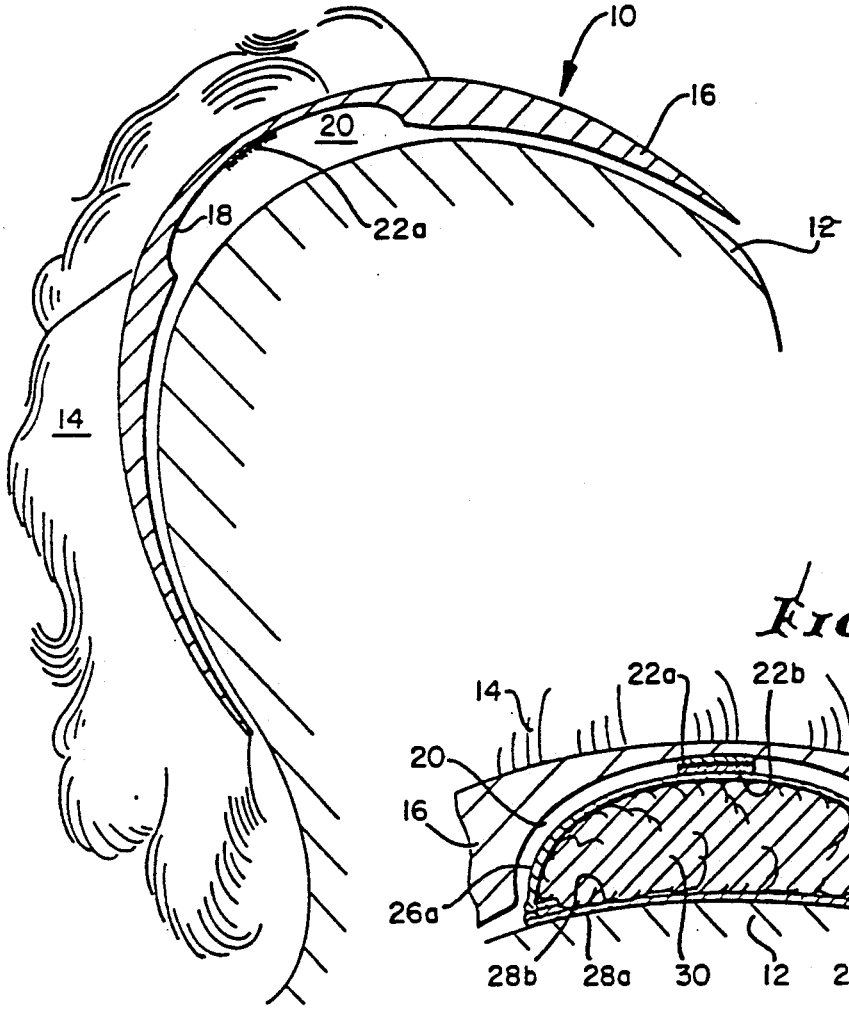
FIG. 1 is a simplified sectional elevation view depicting a conventional wig disposed on a form that represents the head of a wig wearer having no natural hair.

Referring to FIG. 1, conventional wig 10 is disposed over wig form 12, which simulates the head of a wig wearer having little or no natural hair. Wig 10 further comprises a plurality of strands 14 of natural or synthetic hair attached to wig support frame 16. Wig support frame 16 is typically made of a stretchy synthetic fabric, and is manufactured so as to include a hemispherically-shaped depression or hair pocket 18 defining a void 20 bounded by hair pocket 18 and wig form 12. When wig 10 is worn by individuals having a substantial amount of natural hair, the hair can be gathered and stuffed into the void 20 under hair pocket 18 of wig support frame 16. As shown in FIG. 1, hair pocket 18 has been modified by the addition of means 22*a* for engaging and releasably adhering wig support frame 16 to the wig anchor of the invention.

Figure 3:
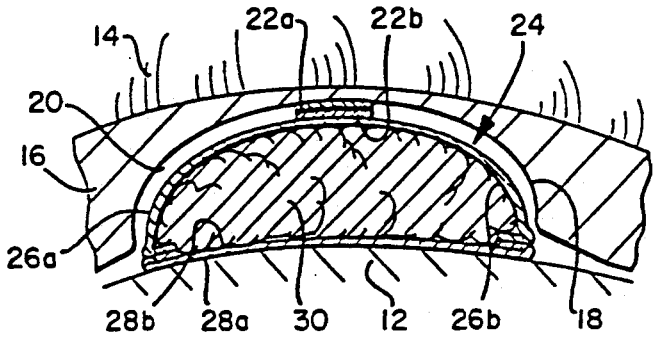
FIG. 3 is a sectional view of the wig anchor of the invention, as installed within the hair pocket of the wig, taken along line 3—3 of FIG. 2.
Figure 2:
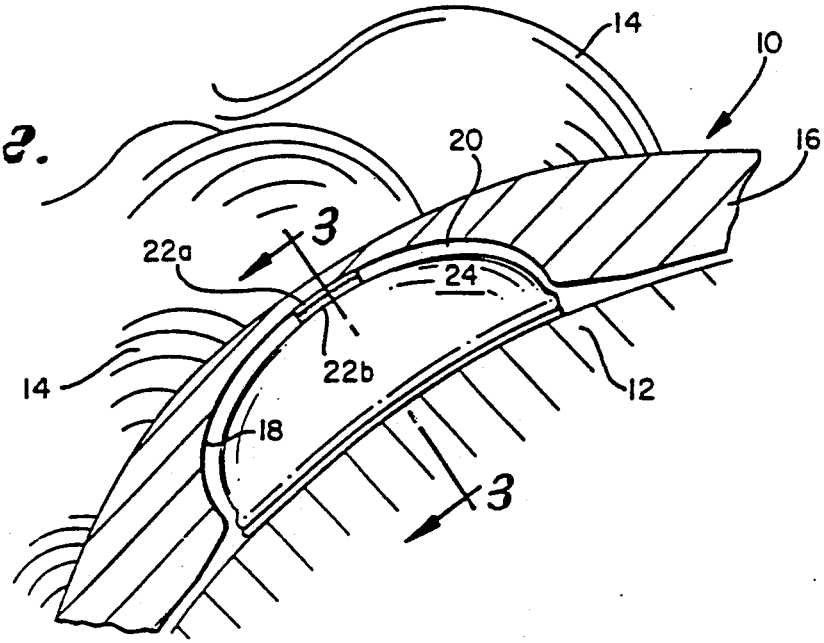
FIG. 2 is a simplified detail view of the sectional elevation view of FIG. 1, depicting the crown portion of a wig disposed on a form representing the head of a wig wearer having no natural hair, as in FIG. 1, but with the wig anchor of the invention disposed over the crown and situated within the hair pocket of the wig.

Referring to FIG. 2, wig anchor 24 of the invention is shown disposed within void 20. Wig anchor 24 is releasably adhered to hair pocket 18 of wig support frame 16 by means of Velcro fastener 22*a*, 22*b* and rests on wig form 12. Referring to FIG. 3, wig anchor 24 is an envelope that preferably further comprises top cover 26, bottom cover 28 and filler material 30.

Top cover 26 further comprises outside surface 26*a* and inside surface 26*b*. Bottom cover 28 further comprises outside surface 28*a* and inside surface 28*b*. Both top cover 26 and bottom cover 28 are preferably constructed from a washable synthetic material such as nylon or polyester. Particularly slick materials such as satin should be avoided for use as top cover 26 and bottom cover 28 of wig anchor 24 since they may contribute to the sliding of wig anchor 24 on the scalp of the wearer. Conversely, stiff, rough or abrasive fabrics should also be avoided for use as top cover 26 or bottom cover 28 of wig anchor 24 since they would likely not conform as well to the head of the wearer, and might also tend t irritate the scalp.

Although a Velcro closure is shown as the preferred fastening means 22*a*, 22*b* for attaching wig anchor 24 to wig support frame 16, it will be readily appreciated by those of ordinary skill in the art that other fastening means such as snaps, hooks, buttons, tape and adhesives will be similarly useful. According to a preferred embodiment of the invention, fastening means 22*a* is stitched to wig support frame 16, and fastening means 22*b* is stitched to outside surface 26*a* of the top cover of wig anchor 24. Alternatively, either or both fastening means 22*a*, 22*b* can be satisfactorily secured by the use of commercially available adhesives suitable for use with the particular material utilized in wig support frame 16 and top cover 26, respectively.

Filler material 30 utilized in wig anchor 24 is preferably a lightweight, compressible solid material such as polyester fiber. Alternatively, other materials such as fluffy cotton, foam rubber, nylon strips, or the like can be satisfactorily utilized within the scope of the invention. The filler material 30 is preferably such that it can be laundered inside of wig anchor 24 without special handling or precautions.

Figure 4:
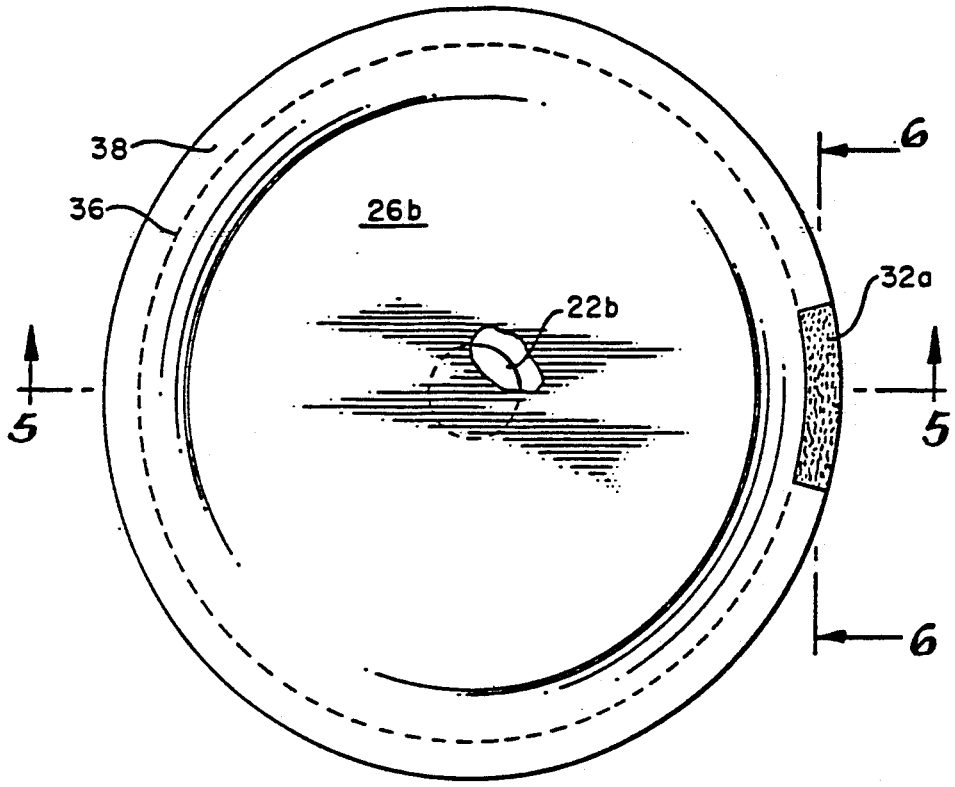
FIG. 4 is a plan view, partially cut-away, of the wig anchor of the invention while turned wrong-side-out prior to the insertion of the filler material.
Figure 5:
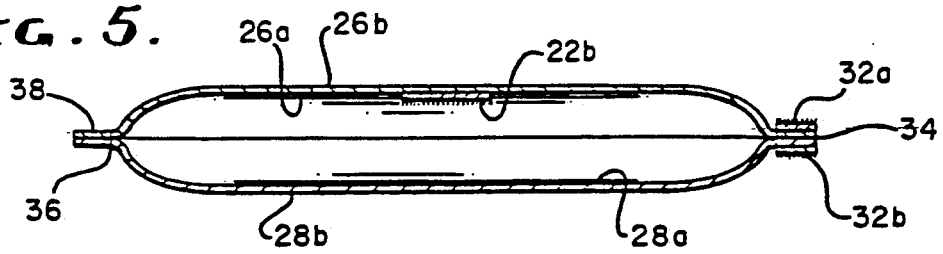
FIG. 5 is a sectional elevation view taken along line 5—5 of FIG. 4.
Figure 6:
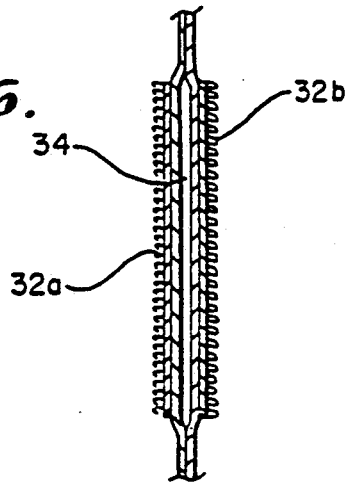
FIG. 6 is a detail sectional view taken along line 6—6 of FIG. 4.

Referring to FIGS. 4 through 6, wig anchor 24 is preferably made by cutting out two round pieces 26, 28 of polyester fabric, each having a diameter of about six (6) inches (15.24 cm). Fastener means 22*b* is then affixed, preferably by stitching, to the center portion of one side of one of the two pieces, which thereby becomes outside surface 26*a* of top cover 26. According to a particularly preferred embodiment of the invention, fastener means 22*b* is a circular patch of Velcro (either the loop or hook side) approximately ¾ inch (1.9 cm) in diameter. If the loop side is utilized as fastener means 22*b*, a hook side Velcro patch should be utilized as fastener means 22*a* attached to wig support frame 16. If the hook side is utilized as fastener means 22*b*, a loop side Velcro patch should be utilized as fastener means 22*a* attached to wig support frame 16.

Once fastener means 22*b* is attached to outside surface 26*a* of top cover 26 of wig anchor 24, top cover 26 is stacked concentrically over the other six (6) inch round piece of fabric (which then becomes bottom cover 28) in such manner that outside surface 26*a* of top cover 26 faces inwardly toward outside surface 28*a* of bottom cover 28. Top cover 26 and bottom cover 28 are then preferably stitched together around line 36, which is desirably inwardly disposed from the outside edge of top cover 26 and bottom cover 28 about ¼ inch (0.635 cm), thereby creating border 38. It should be noted that although stitch line 36 extends substantially around the entire circumference of top cover 26 and bottom cover 28, a relatively small gap of from about 1 inch (2.54 cm) to about 2 inches (5.08 cm) along the circumference of top cover 26 and bottom cover 28 should remain unstitched for reasons discussed in more detail below. This small unstitched gap 34 is shown with greater clarity in FIG. 6.

Once top cover 26 and bottom cover 28 are sewn together as disclosed above, closure means 32*a*, 32*b* are desirably attached, preferably by stitching, to top cover 26 and bottom cover 28, respectively, above and below unstitched gap 34. Closure means 32*a*, 32*b* can be selected from many commercially available reversible fastening devices, although preferred closure means 32*a*, 32*b* for use with the present invention are cooperating Velcro strips. These Velcro strips preferably have a width of slightly less than about ¼ inch (0.635 cm), which corresponds to the width of border 38 around top cover 26 and bottom cover 28 outside of stitched line 36. The preferred length for the Velcro strips utilized as reversible closure means 32*a*, 32*b* is approximately the same length as that of unstitched gap 34. One of the Velcro strips utilized as closure means 32*a*, 32*b* preferably comprises hooks, and the other comprises loops. Closure means 32*a* is preferably stitched to inside surface 26*b* of top cover 26, and closure means 32*b* is preferably stitched to inside surface 28*b* of bottom cover 28 as shown in FIG. 5. Alternatively, closure means 32*a*, 32*b* can be attached to top cover 26 and bottom cover 28, respectively, prior to stitching the covers together along stitch line 36 if desired.

Once wig anchor 24 has been constructed as described above, or in another functionally equivalent manner, top cover 26 and bottom cover 28 are reversed by pulling them back through unstitched gap 34. In this manner, inside surfaces 26*b*, 28*b* of top and bottom covers 26, 28, respectively, become the inwardly facing surfaces of wig anchor 24, and border 38 becomes concealed interiorly of stitched line 36. Similarly, closure means 32*a*, 32*b* are brought into facing and cooperating alignment with each other so as to permit substantially complete closure around the circumference of top and bottom covers 26, 28 of wig anchor 24 when desired.

Prior to bringing closure means 32*a*, 32*b* into contact, however, filler material 30 is desirably inserted into the interior void defined by inside surfaces 26*b*, 28*b* of wig anchor 24. Sufficient filler material 30 should be added to wig anchor 24 that its volume approximates, but is slightly less than, the volume of void 20 between hair pocket 18 of wig support frame 16 and wig form 12, or the head of the user.

In some instances, where the head of the wearer is unusually small relative to the size of the wig, it may be desirable to use two wig anchors of the type disclosed herein instead of one, with one wig anchor being positioned adjacent the top of the wearer's head, forward of the crown, and the other being disposed somewhat rearwardly of the crown, toward the back of the head.

According to another embodiment of the invention, a kit is provided that preferably comprises wig anchor 24 of the invention in combination with excess filler material 30 for insertion inside wig anchor 24 by the user, and fastening means 22*a* selected to function cooperatively with fastening means 22*b* attached to top cover 26. Optionally, means for attaching fastening means 22*a* to wig support frame 16 can also be included within the kit of the invention. Such means can include, by way of example and without limitation, needle and thread, tape, adhesive, or the like.

Other alterations and modifications of the invention disclosed herein will likewise become obvious to one of ordinary skill in the art upon reading this disclosure, and it is intended that this patent application cover all such alterations and modifications as fall within the scope of the appended claims.

In summary, the invention provides in combination with a wig having a frame forming a concave underside surface, and a shallow pocket formed by the frame and opening at said surface, the pocket having cross dimensions substantially greater than its depth, an article adapted to assist in positioning and maintaining said wig on the head of a wearer having little or no natural hair, said article having the shape of a shallow pad fitting loosely in said pocket and comprising an envelope to be disposed in retaining engagement with the head of said wearer, said envelope having a first side substantially conforming to the surface of the pocket and a second side adapted to substantially conform to that portion of the head of the wearer facing the pocket, and a mass of fibrous compressible filler material within said envelope, said filler material confined by the envelope to have pad shape, and means for locally attaching said envelope to said frame interiorly of said pocket, said mass of fibrous material causing the pad to protrude from said pocket.

We claim:

1. In combination with a wig having a frame forming a concave underside surface, and a shallow pocket formed by the frame and opening at said surface, the pocket having cross dimensions substantially greater than its depth, an article adapted to assist in positioning and maintaining said wig on the head of a wearer having little or no natural hair, said article having the shape of a shallow pad fitting loosely in said pocket and comprising an envelope to be disposed in retaining engagement with the head of said wearer, said envelope having a first side substantially conforming to the surface of the pocket and a second side adapted to substantially conform to that portion of the head of the wearer facing the pocket, and a mass of fibrous compressible filler material within said envelope, said filler material confined by the envelope to have a pad shape, and means for locally attaching said envelope to said frame interiorly of said pocket, said mass of fibrous material causing the pad to protrude from said pocket.

2. The combination of claim 1, wherein said envelope further comprises a locally confined releasable passageway at the envelope periphery to permit the insertion and removal of all or a portion of said filler material into or from said envelope to thereby achieve fitting of the wig and envelope to the head of the wearer.

3. The combination of claim 2 wherein said envelope further comprises two substantially circular panels of fabric joined in facing concentric relation to each other substantially around the entire periphery of such panels to define a void therebetween adapted to accommodate said filler material.

4. The combination of claim 3 wherein the periphery of said first side and said second side of said envelope adjacent to said passageway are joined by a releasable fastener means after said filler material is inserted into said envelope.

5. The combination of claim 1 wherein said filler material is a compressible material having a low bulk density.

6. The combination of claim 4 wherein said filler material is selected from the group consisting of spun polyester fiber or cotton fiber.

7. The combination of claim 1 wherein said means for attaching said envelope to the frame is a releasable fastener means.

* * * * *